US005726136A

United States Patent [19]

Koch

[11] Patent Number: 5,726,136

[45] Date of Patent: Mar. 10, 1998

[54] MULTIFUNCTIONAL ADDITIVE FOR LUBRICATING OILS COMPATIBLE WITH FLUOROELASTOMERS

[75] Inventor: Paolo Koch, Melegnano, Italy

[73] Assignee: Agip Petroli S.p.A., Rome, Italy

[21] Appl. No.: 539,478

[22] Filed: Oct. 5, 1995

[30] Foreign Application Priority Data

Oct. 19, 1994 [IT] Italy ..... MI94A2132

[51] Int. Cl.[6] ..... C10M 145/14; C10M 133/04; C10M 133/16; C08F 220/18

[52] U.S. Cl. ..... 508/469; 508/470; 508/471; 526/329.5; 526/328.5; 526/329.7

[58] Field of Search ..... 252/56 S, 51.5 A; 526/329.5, 328.5, 329.7; 508/469, 470, 471

[56] References Cited

U.S. PATENT DOCUMENTS

| | | | |
|---|---|---|---|
| 2,604,453 | 7/1952 | Popkin | 252/56 R |
| 3,198,739 | 8/1965 | Richards et al. . | |
| 3,304,260 | 2/1967 | Fields et al. | 252/51.5 |
| 3,598,736 | 8/1971 | Van der Meij et al. | 252/56 R |
| 3,598,737 | 8/1971 | Van der Meij et al. | 252/56 R |
| 3,772,258 | 11/1973 | Lachowicz | 260/86.1 E |
| 3,869,396 | 3/1975 | Van de Kraats et al. | 252/56 R |
| 3,897,353 | 7/1975 | Morduchowitz et al. | 252/51.5 A |
| 4,465,603 | 8/1984 | Koch . | |
| 4,618,439 | 10/1986 | Brandi et al. . | |
| 4,867,894 | 9/1989 | Pennewiss et al. | 252/56 R |
| 4,968,444 | 11/1990 | Knoell et al. | 252/56 R |
| 5,021,174 | 6/1991 | Koch et al. . | |
| 5,156,564 | 10/1992 | Koch et al. . | |
| 5,188,770 | 2/1993 | Pennewiss . | |
| 5,248,315 | 9/1993 | Gatti et al. . | |
| 5,312,884 | 5/1994 | Gore et al. | 526/328 |
| 5,322,632 | 6/1994 | Gambini et al. . | |
| 5,370,807 | 12/1994 | Gambini et al. . | |
| 5,466,387 | 11/1995 | Pianta et al. . | |

FOREIGN PATENT DOCUMENTS

| | | |
|---|---|---|
| 0153209 | 8/1985 | European Pat. Off. . |
| 436872 | 12/1990 | European Pat. Off. . |
| A-1173356 | 3/1957 | France . |
| 1347713 | 2/1974 | United Kingdom . |
| 1525070 | 9/1978 | United Kingdom . |

OTHER PUBLICATIONS

U.S.S.N. 508,330, filed Jun. 15, 1982.
U.S.S.N. 475,401, filed Mar. 15, 1983.

*Primary Examiner*—Margaret Medley
*Attorney, Agent, or Firm*—Rogers & Wells; George P. Hoare

[57] ABSTRACT

A description follows of an additive for lubricating oils which is a viscosity-index improver, with dispersing properties and stable towards fluoroelastomers, having a greater shear stability and improved rheological behaviour at low temperature. The above additive is prepared by the polymerization of a composition of particular poly(meth) acrylates.

18 Claims, No Drawings

MULTIFUNCTIONAL ADDITIVE FOR LUBRICATING OILS COMPATIBLE WITH FLUOROELASTOMERS

The present invention relates to an additive for lubricating oils which is a viscosity index improver, with dispersing properties and stable towards fluoroelastomers, having a greater shear stability and improved rheological behaviour at low temperature.

Fluorinated elastomers are commonly used as seals in internal combustion engines, particularly to avoid fuel loss at the points in which parts are in contact with the engine.

In fact fluorinated elastomers have an almost unique combination of excellent thermal stability and resistance to various types of fluids. The above fluorinated seals can be attacked however, under the operating conditions of the engine, by nitrogen containing components contained in lubrucating oils, and in particular by amines with a basic character.

It seems certain in fact that the above attack consists in the base-catalized elimination of hydrofluoric acid, with the consequent formation of unsaturations. As regards the mechanical properties, the fluoroelastomer thus deteriorated loses its elasticity and elongation capacity, with a consequent loss in its sealing capacity.

Viscosity index improver additives (V.I.I.) capable of improving the rheological behaviour with varying temperatures are known in the technical field of lubricating oils.

Belonging to this group are polymers and copolymers of alkyl esters of acrylic or methacrylic acid, containing a sufficient number of carbon atoms in the alkyl group to make it oil-soluble.

The advantages which can be obtained by introducing into this oil-soluble polymer a copolymerizable or graftable monomer containing nitrogen in order to give the resulting product dispersing characteristics, as well as those for improving the viscosity index, are also known in the art.

This copolymerizable monomer containing nitrogen, also called dispersing monomer, is generally selected from vinylimidazoles, vinyl pyrrolidones, vinyl pyridines and N,N-dialkyl-amino-alkyl-methacrylates.

As specified above, these poly(meth)acrylates are efficient viscosity index improvers and dispersers but have the disadvantage of being incompatible with fluoroelastomers.

To overcome these disadvantages, the known art describes V.I.I. polymers not having nitrogen containing groups, but normally hydroxylic (—OH) or alkoxidic (—OR, where R is generally a monofunctional $C_1$–$C_4$ alkyl radical) groups. These polymers are completely inert with respect to fluoroelastomers, but obviously have a lesser dispersing activity.

A new class of copoly(meth) acrylates which are viscosity index improvers with a dispersing action has now been found, in which the contemporaneous presence of nitrogen and oxygen containing groups surprisingly improve the viscosimetric performance of the polymer, such as mechanical stability and cold and hot thickening, also making it compatible with fluoroelastomers although containing nitrogenated functions.

In accordance with this, the present invention relates to a viscosity index improving polymeric additive with a dispersing action and compatible with fluoroelastomers, said polymeric additive basically consisting of a copoly(meth) acrylate characterized in that it is obtained by the copolymerization in an inert solvent of a composition of monomers comprising:

a) (meth)acrylates having general formula (I) $CH_2$=C(R)-COOR1, in a quantity of between 0 and 19% by weight, preferably between 0 and 10%, wherein R is selected from —H and —$CH_3$, $R_1$ is selected from linear or branched, $C_1$–$C_4$ alkyl radicals;

b) (meth)acrylates having general formula (II) $CH_2$=C(R)—$COOR_2$, in a quantity of between 85 and 98% by weight, preferably between 88 and 97% by weight, wherein R has the above meaning and $R_2$ is selected from linear or branched alkyl radicals having a number of carbon atoms of between 6 and 25, preferably between 10 and 20;

c) (meth)acrylates having general formula (III) $CH_2$=C(R)—CO—X—$R_3$, in a quantity of between 1 and 6% by weight, preferably between 1.5 and 5% by weight, wherein R has the above meaning, —X— is oxygen or —NH or $NR_4$, wherein $R_4$ is an alkyl radical having from 1 to 5 carbon atoms, and $R_3$ is selected from linear, branched or cyclic alkyl radicals having a total number of carbon atoms of between 4 and 20 and a number of tertiary nitrogen atoms of from 1 to 2;

d) (meth)acrylates having general formula (IV) $CH_2$=C(R)—$COOR_5$, in a quantity of between 1 and 9% by weight, preferably between 1.5 and 7% by weight, wherein R has the above meaning and $R_5$ is selected from linear, branched or cyclic alkyl radicals having a number of carbon atoms of between 2 and 20 and a number of oxygen atoms of the hydroxyl and/or alkoxyl type of between 1 and 2, the term alkoxyl meaning a —$OR_6$ group, wherein $R_6$ is a linear or branched $C_1$–$C_4$ alkyl radical, the total percentage of the components from (a) to (d) being equal to 100, the above composition of polymerizable monomers being further characterized in that the ratio between the equivalents of oxygen of the (meth)acrylates of (d) and the equivalents of nitrogen of the (meth)acrylates of (c) is between 1/1 and 2/1, preferably between 1.1/1 and 1.6/1.

With respect to the monomers (a), typical examples are (meth)acrylates, preferably the methacrylates of methyl, ethyl, propyl, isopropyl, n-butyl, isobutyl, ter-butyl, and relative mixtures.

In the preferred embodiment the monomers (b) are methacrylates of mixtures of primary, linear or branched, alcohols, both of a natural and synthetic origin, having a number of carbon atoms of between 10 and 20. The above mixtures easily available on the market. Belonging to this category are fatty alcohols from tallow oil (having a number of carbon atoms of between 16 and 20, usually 17.3), fatty alcohols from coconut oil (having a number of carbon atoms of between 10 and 16, usually 12.6), synthetic alcohols such as "Dobanol 25" (mixture of linear and branched alcohols having a number of carbon atoms of between 12 and 15, usually 13.5), primary linear and branched from $C_{12}$ to $C_{15}$ alcohols, usually 13.3, known as "LIAL 125".

Belonging to the group of (meth)acrylates (c) are compounds wherein —X— is —O— and $R_3$ is a dialkylaminic alkylene group, in particular 2-dimethylamino and 2-diethylamino ethyl (meth)acrylates, 3-dimethyl and 3-diethyl aminopropyl (meth)acrylates. Compounds wherein —X— is —NH, for example N-(dimethylaminopropyl) (meth)acrylamide, also belong to this group.

Belonging to this group are also monomers wherein the nitrogen is part of a heterocycle product, for example 2-(1-imidazolyl)ethyl (meth)acrylates, 2-(4-morpholine) ethyl (meth)acrylates, (meth) acrylates of N-(3-hydroxypropyl)-N'-methyl-piperazine, and the corresponding amides.

Examples of (meth)acrylates (d) are (meth)acrylates having an —OH group in the alkyl chain of $R_5$, particularly in a chain-end position, such as 2-hydroxyethyl (meth)acrylate, 3-hydroxypropyl (meth)acrylate. Equally useful are (meth) acrylates having the hydroxyl in position 2 of the alkyl chain, for example (meth)acrylates of 2-hydroxy butyl and 2-hydroxypropyl. 2-hydroxypropyl and 3-hydroxypropyl (meth)acrylates and the relative mixtures have proved to be particularly interesting. The respective $C_1$–$C_4$ alkyl ethers of the above hydroxylated (meth)acrylates obviously belong to this group.

The present invention further relates to a process for the preparation of the copoly(meth)acrylate described above, this process being characterized in that, when the total percentage of the polymerizable (meth)acrylic monomers is 100, a) the polymerization reactor is charged with a quantity of between 25% and 55%, preferably between 30% and 50%, of polymerizable monomers and with almost the total quantity of the reaction catalyst, b) the reactor is fed with the remaining quantity of polymerizable monomeric composition in a time of between 10 and 120 minutes, preferably form 15 to 80 minutes, c) the polymerization is continued until a conversion degree of the monomers of more than 97%, preferably higher than 98%, the above process being carried out at temperatures of between 75° C. and 130° C., preferably between 80° C. and 100° C.

With the above process V.I.I. poly(meth)acrylates with a dispersing action can be obtained, which are compatible with fluoroelastomers and which also have a high shear stability. The importance of the shear stability is obvious as the lubricating oils are applied in the motor field.

Step (b) can be carried out at a constant or varying flow rate, although it is preferable and easier to maintain an almost constant flow rate during this step.

As far as the solvent is concerned, this can be totally charged into the reactor or a part of it can be used to dilute the monomers fed during step (b).

The polymerization reaction is carried out, as known to experts in the field, in an inert gas atmosphere, preferably nitrogen. It is also useful to eliminate traces of oxygen from the reagents and reaction environment; it is therefore appropriate to subject the reagents and reacton environment to previous degassing.

It is important for the ratio between the quantity of monomers initially charged into the reactor and the quantity of monomers subsequently fed to be within the above range. In fact it has been surprisingly found that operating as such the poly(meth)acrylates have an excellent rheological behaviour at cold temperature and an improved shear stability. The V.I.I. and dispersing properties, as well as the stability to fluoroelastomers, are on the other hand almost the same, obviously with the same type and quantity of monomers, as products obtained with other techniques (i.e. either polymerizing the monomeric composition totally charged from the beginning into the reactor or operating outside the ratios between the charge and subsequent feeding defined in the present invention).

The copolymerization reaction is carried out in an inert solvent, preferably having a boiling point of at least 300° C. at 760 mm. Particularly convenient are mineral oils, for example Solvent Neutral 5.4 cSt at 100° C., commonly known as Solvent Neutral 150.

The quantity of solvent is preferably selected so as to have, at the end of the polymerization reaction, a polymeric solution with a concentration of polymer of between 30 and 65% by weight, preferably between 50% and 60%. In this way the above solution can be used directly as an additive for lubricating oils.

The polymerization reaction is carried out without oxygen at a temperature of between 75° and 130° C., particularly between 80° and 100° C. in the presence of a radicalic initiator.

The addition time of the remaining polymerizable composition (step b), although depending on the polymerization temperature, is generally between 10 and 120 minutes, preferably between 15 and 80 minutes. Operating in the preferred form of embodiment, i.e. with a temperature of between 80° and 100° C., the addition time is usually between 20 and 45 minutes, preferably between 25 and 35 minutes.

Typical radicalic catalysts which can be used for the process of the present invention are ter-butyl peroctoate, ter-butyl perbenzoate, azobis-isobutyronitrile, 2,2'-azobis(2-methylbutyronitrile), dibenzoylperoxide, di-lauroylperoxide. The above catalysts are added in a quantity of between 0.2 and 3 parts by weight per 100 parts of monomer.

The reaction mixture may also contain, when considered suitable, sulphurated substances such as alkyl mercaptans, thioglycols and thiophenols, to regulate the molecular weight of the copolymer. These sulphurated substances can be present in a quantity of between 0.01 and 0.5 parts per 100 parts of monomers.

The progress of the polymerization reaction can be followed by analyses, preferably infra-red analyses, of samples of the reaction mixture.

The polymerization reaction is considered to be complete when the conversion degree of the monomers is ≧97%, preferably ≧98%.

The copoly(meth)acrylate of the present invention can be isolated from the final polymeric solution and used directly in base, mineral or synthetic oils, or the final polymeric solution can be used as a concentrate. When used as a concentrate, it is possible to dilute the polymeric solution to the desired concentration with further diluent, for example paraffin oil.

When the concentrate is directly mixed to give a formulated oil, the preferred diluent is a SN100 or SN150 mineral oil which is compatible with the final lubricating oil.

When the copoly(meth)acrylate of the present invention is added to base oils for fuels, the final concentration of the polymer (active part) in the final lubricating oil is preferably from 0.5% to 15% by weight, even more preferably from 1% to 8% by weight, depending on the specific applications.

The base oils for fuels can by of the mineral type (paraffinic or naphthenic) or synthetic (polyolefin or ester).

The copoly(meth)acrylate of the present invention can be used in the final formulation of lubricating oils with other additives having different functions, for example antioxidants, detergents, dispersers, antiwear agents, or mixtures with other compounds having the same function, for example with other viscosity index improvers, other dispersers, other V.I.I.s with a dispersing action. These other additives are generally commercially available in formulations containing the various additives in defined proportions. For example a typical commercial formulation comprises an antiwear additive and antioxidant, such as zinc dithiophosphonate, a nitrogenated ashless disperser, such as a polyisobutylene succinimide, a detergent, such as a metallic sulphonate or phenate, an antifoam agent, such as silicon oil.

The following examples provide a better understanding of the present invention.

EXAMPLE 1

For the production of 300 grams of polymer a jacketed cylindrical reactor is used, having a capacity of 0.5l, equipped with an anchor stirrer with oriented blades on the rod, thermocouple and an immersed tube for nitrogen blowing, the jacket being connected to a thermostat-regulated bath which permits thermal control of the reaction. A dosage micropump is also used. 132.6 g of mineral oil SN 150, 48.2 g (0.174 moles) of C12–C18 alkylmethacrylic monomer (98.5% of purity) are charged into the reactor; the whole mixture is degassed for an hour with nitrogen under stirring. At the end of the degassing 1.13 g (0.00785 moles) of hydroxypropylmethacrylate and 0.9 g (0.00573 moles) of dimethylaminoethylmethacrylate are added.

112.5 g (0.407 moles) of C12–C18 methacrylic monomer are charged into a separate container and degassed for an hour with nitrogen. At the end of the degassing 2.63 g (0.0183 moles) of hydroxypropylmethacrylate and 2.1 g (0.0134 moles) of dimethylaminoethylmethacrylate are added. The hydroxypropylmethacrylate used in this and in the following examples is a commercial product consisting of a 75/25 by weight mixture of 2-hydroxypropyl and 3-hydroxypropyl. This mixture of methacrylates is then fed to the reactor during the polymerization by means of the dosage pump.

The quantity of methacrylic monomers charged into the polymerization reactor represents 30% of the total weight of monomers used, whereas the quantity of monomers present in the feeding container of the pump represents the remaining 70%.

The ratio in moles between hydroxypropylmethacrylate and dimethylaminoethylmethacrylate in the total mixture of monomers is equal to 1.37:1.

The weight percentages of hydroxypropylmethacrylate and dimethylaminoethylmethacrylate in the total mixture of monomers are 2.28% and 1.82% respectively.

The reaction mixture contained in the reactor is heated to 80° C.

At this point 0.96 g of polymerization initiator 2,2'-azobis (2-methylbutyronitrile), equal to 0.32% by weight with respect to the reaction mixture, are added and the polymerization temperature is left to rise to 90° C. after which the mixture of monomers contained in the feeding container of the dosage pump is added at a flow rate which enables the addition to be completed in 30 minutes.

The reaction temperature is controlled in order to maintain 90° C. for the whole duration of the polymerization. The development of the reaction is followed by I. R. analysis carried out on samples taken from the reactor every 30 minutes approximately. From an examination of the spectrum it is possible to follow the disappearance of the absorptions due to the mixture of methacrylic monomers and the appearance of absorptions due to the polymer.

The reaction is considered to be complete when the conversion degree is higher than 98%; this occurs after 210 minutes after the polymerization temperature has been reached. The additive obtained has a final active part corresponding to 54.1% by weight (determined by dialysis).

It has a limpid appearance and its kinematic viscosity measured at 100° C. proves to be 970 cSt.

The main rheological properties of the additive are determined by convention on a solution of the additive dissolved at 10% by weight in SN 150 mineral oil.

The solution thus obtained has the following characteristics:

Kinematic viscosity (KV) at 100° C.: 13.36 cSt
KV at 40° C.: 72.56 cSt
Viscosity index: 189
Shear stability (test CEC-L-14-A 88): 10.8%
Shear Stability Index: 17.5
Dynamic viscosity at −20° C.: 2800 cP
Pour Point: −33° C.

To evaluate the product as an additive for motor oil, a formulation with SAE number 10W-40 is used, containing:

37.8% of mineral bases,
38% of synthetic bases,
14.7% of a commercial set of additives (consisting of zincodithiophosphate, a detergent, a disperser, an antioxidant system),
9.5% of Viscosity index improvers, of which the additive in question (intended as a 55% solution of the polymer in SN150) forms 6%, the remaining part consisting of a polyolefinic non-disperser V.I.I. additive.

A first test is carried out to examine the compatibility with fluoroelastomers with the formulation thus prepared.

For this purpose the test called "VW TEST PV 3344—Seal compatibility" is carried out.

The results of the above test are shown in table 1, where the product specification limit is indicated in brackets.

TABLE 1

| | |
|---|---|
| Tensile strength (MPa) | 9.0 (≧8.0) |
| Elongation at break (%) | 210 (≧160) |
| Cracks at 100% | No cracks (no cracks) |

For the motoristic evaluation of the dispersing action the same formulation as above was used, on which the American motoristic test called Sequence V-E (procedure ASTM STP 315H P3) was carried out, the results of which are shown in table 2, together with the product specification limits, in brackets.

TABLE 2

| | |
|---|---|
| Average engine sludge | 9.28 (minimum 9) |
| Average cope sludge | 9.25 (minimum 7) |
| Average engine laquers | 5.60 (minimum 5) |
| Piston skirt laquers | 6.80 (minimum 6.5) |
| Average cam wear (mils) | 0.50 (maximum 5) |
| Maximum cam wear (mils) | 0.8 (maximum 15) |

EXAMPLE 2

For the production of 300 grams of polymer the same procedure is used as in example 1, but charging 40% of the total quantity of monomers into the reactor and adding the remaining 60% with the dosage pump.

For this purpose 132.6 g of SN 150, 64.28 g (0.233 moles) of C12–C18 alkylmethacrylic monomer(98.5% purity) are charged into the reactor and degassed with nitrogen for an hour. 2.31 g (0.0147 moles) of dimethylaminoethylmethacrylate and 2.54 g (0.0176 moles) of hydroxypropylmethacrylate are then added. 96.42 g (0.349 moles) of C12–C18 alkylmethacrylic monomer are charged into the feeding container of the pump and are degassed for an hour with nitrogen. 3.47 g (0.022 moles) of dimethylaminoethylmethacrylate and 3.81 g (0.0264 moles) of hydroxypropylmethacrylate are then added. The ratio in moles between hydroxypropylmethacrylate and dimethylaminoethylmethacrylate in the total mixture of monomers is 1.2:1.

The weight percentages of hydroxypropylmethacrylate and dimethylaminoethylmethacrylate in the total mixture of monomers are equal to 3.85 and 3.50% respectively. When the reaction mixture reaches 80° C., 0.96 g of polymerization initiator 2,2'-azobis(2-methylbutyronitrile) are added and the temperature is left to rise to 90° C., after which the mixture of monomers contained in the feeding container is added over a period of 30 minutes. After 210 minutes from the beginning of the reaction a sample is taken and the conversion is determined, which proves to be 98%.

The solution at 10% of the polymer in SN 150 has the following characteristics:
Kinematic viscosity (KV) at 100° C.: 13.28 cSt
KV at 40° C.: 71.38 cSt
Viscosity index: 191
Shear stability (test CEC-L-14-A 88): 10.6%
Shear Stability Index: 17.0
Dynamic viscosity at −20° C.: 2800 cP
Pour Point: −33° C.

Table 3 shows the results of the VW Test PV 3344

TABLE 3

| | |
|---|---|
| Tensile strength (MPa) | 8.8 (≧8.0) |
| Elongation at break (%) | 205 (≧160) |
| Cracks at 100% | No cracks (no cracks) |

COMPARATIVE EXAMPLE 3

The same procedure is carried out as in example 1 using dimethylaminoethylmethacrylate alone as dispersing monomer. 132.6 g of mineral oil SN 150, 48.2 g (0.174 moles) of C12–C18 alkylmethacrylic monomer with a 98.5% purity, are charged into the reactor; the whole mixture is degassed for an hour with nitrogen under stirring. At the end of the degassing 1.73 g (0.011 moles) of dimethylaminoethylmethacrylate are added. 112.5 g (0.407 moles) of C12–C18 methacrylic monomer are charged separately into the feeding container of the dosage pump; the whole mixture is degassed for an hour with nitrogen. At the end of the degassing 4.04 g (0.0257 moles) of dimethylaminoethylmethacrylate are added.

The quantity of methacrylic monomers present in the polymerization reactor represents 30% by weight of the total monomers used, whereas the feeding container of the dosage pump contains the remaining 70%.

The total quantity of dimethylaminoethylmethacrylate used represents 3.5% of the total weight of methacrylic monomers.

After heating the reaction mixture to 80° C., 0.96 g of polymerization initiator 2,2'-azobis(2-methylbutyronitrile) are added. The temperature is left to rise to 90° C. after which the mixture of methacrylic monomers contained in the feeding container is added in 30 minutes, the reaction temperature being maintained at 90° C.

After 210 minutes from the beginning of the reaction a sample is taken, the conversion is measured and proves to be 98%.

The solution at 10% of the polymer in SN 150 has the following characteristics:
Kinematic viscosity (KV) at 100° C.: 13.10 cSt
KV at 40° C.: 71.59 cSt
Viscosity index: 187
Shear stability (test CEC-L-14-A 88): 10.5%
Shear Stability Index: 17.0
Dynamic viscosity at −20° C.: 3200 cP
Pour Point: −33° C.

Table 4 shows the results of the VW test PV 3344 for compatibility with fluoroelastomers which is a complete failure.

TABLE 4

| | |
|---|---|
| Tensile strength (MPa) | 6.5 (≧8.0) |
| Elongation at break (%) | 155 (≧160) |
| Cracks at 100% | Cracks/Break (No cracks) |

COMPARATIVE EXAMPLE 4

The same procedure is carried out as in example 1 using hydroxypropylmethacrylate alone as dispersing monomer.

132.6 g of mineral oil SN 150, 48.2 g (0.174 moles) of C12–C18 alkylmethacrylic monomer with a 98.5% purity, are charged into the reactor; the whole mixture is degassed for an hour with nitrogen under stirring. At the end of the degassing 1.91 g (0.0132 moles) of hydroxypropylmethacrylate are added. 112.5 g (0.407 moles) of C12–C18 methacrylic monomer are charged separately into the feeding container of the dosage pump; the whole mixture is degassed for an hour with nitrogen. At the end of the degassing 4.45 g (0.031 moles) of hydroxypropylmethacrylate are added.

The quantity of methacrylic monomers present in the polymerization reactor represents 30% by weight of the total monomers used, whereas the feeding container of the dosage pump contains the remaining 70%.

The total quantity of hydroxypropylmethacrylate used represents 3.85% of the total weight of methacrylic monomers.

After heating the reaction mixture to 80° C., 0.96 g of polymerization initiator 2,2'-azobis(2-methylbutyronitrile) are added.

The temperature is left to rise to 90° C. after which the mixture of methacrylic monomers contained in the feeding container is added in 30 minutes, the reaction temperature being maintained at 90° C.

After 210 minutes from the beginning of the reaction a sample is taken, the conversion is measured and proves to be 98%.

The solution at 10% of the polymer in SN 150 has the following characteristics:
Kinematic viscosity (KV) at 100° C.: 13.20 cSt
KV at 40° C.: 70.49 cSt
Viscosity index: 192
Shear stability (test CEC-L-14-A 88): 10.5%
Shear Stability Index: 17.0
Dynamic viscosity at −20° C.: 3300 cP
Pour Point: −33° C.

Table 5 shows the results of the VW test PV 3344 for compatibility with fluoroelastomers.

TABLE 5

| | |
|---|---|
| Tensile strength (MPa) | 10.2 (≧8.0) |
| Elongation at break (%) | 240 (≧160) |
| Cracks at 100% | No cracks (No cracks) |

COMPARATIVE EXAMPLE 5

The same reactor is used but all the components of the reaction mixture are fed right from the beginning, thus excluding the dosage pump and relative feeding container. 132.6 g of SN 150 and 160.7 g (0.582 moles) of C12–C18 alkylmethacrylic monomer (98.5% purity) are fed into the reactor, and are degassed with nitrogen for an hour under stirring. At the end of the degassing 5.78 g (0.0368 moles)

of dimethylaminoethylmethacrylate and 6.35 (0.0441 moles) of hydroxypropylmethacrylate are added.

The ratio in moles between hydroxypropylmethacrylate and dimethylaminoethylmethacrylate in the total mixture of monomers is 1.2:1, as in example 2. The reaction mixture contained in the reactor is heated to 80° C.

At this point 1.44 grams of polymerization initiator 2,2'-azobis(2-methylbutyronitrile), equal to 0.48% by weight with respect to the reaction mixture, are added.

The temperature is left to rise to 90° C. and this temperature is maintained for 150 minutes. A sample is then taken and the conversion degree is determined and proves to be 98%.

The solution at 10% of the polymer in SN 150 has the following characteristics:

Kinematic viscosity (KV) at 100° C.: 13.30 cSt
KV at 40° C.: 72.21 cSt
Viscosity index: 189
Shear stability (test CEC-L-14-A 88): 15.5%
Shear Stability Index: 26
Dynamic viscosity at −20° C.: 3000 cP
Pour Point: −33° C.

Table 6 shows the results of the compatibility test with fluoroelastomers.

TABLE 6

| | |
|---|---|
| Tensile strength (MPa) | 8.9 (≧8.0) |
| Elongation at break (%) | 211 (≧160) |
| Cracks at 100% | No cracks (No cracks) |

Table 7 is a summarized table in which the properties of the products described above can be easily compared. In this table VW indicates the VW PR 3344 test, the initials SSI indicate the Shear Stability Index), CCS-20° C. is the viscosity at −20° C., Ve is the VE motoristic test.

TABLE 7

| | EVALUATIONS | | | |
|---|---|---|---|---|
| EXAMPLE | VW TEST | SSI | CCS-20° C. | VE |
| 1 | PASS | 17.5 | 2800 cP | PASS |
| 2 | PASS | 17.0 | 2800 cP | — |
| 3 comp. | FAIL | 17.0 | 3200 cP | — |
| 4 comp. | PASS | 17.0 | 3300 cP | — |
| 5 comp. | PASS | 25.0 | 3000 cP | — |

Examples 1 and 2 (with additives containing the mixture of the two nitrogen and oxygen containing monomers) show with respect to examples 3 and 4 (containing a single nitrogenated (example 3) or oxygenated (example 4) monomer:

A) compatibility with fluoroelastomers also in the presence of the same quantity of nitrogenated monomer (examples 2 and 3);

B) lower viscosity at cold temperature and therefore better performance in the formulation of multrigrade lubricants (5W–X and 10W–X).

Comparative example 5, in which all the reagents are charged at the beginning, shows on the other hand a decisively lower shear stability.

I claim:

1. A polymeric additive, viscosity index improver with a dispersing action and compatible with fluoroelastomers, said polymeric additive basically consisting of a copoly(meth) acrylate characterized in that is it obtained by the copolymerization in an inert solvent of a composition of monomers which comprises:

a) (meth)acrylates having the general formula (I), $CH_2$=C(R)—$COOR_1$, in a quantity of between 0 and 19% by weight, and wherein R is selected from —H and —$CH_3$, $R_1$ is selected from linear or branched, $C_1$–$C_4$ alkyl radicals;

b) (meth)acrylates having the general formula (II), $CH_2$=C(R)—$COOR_2$, in a quantity of between 85 and 98% by weight, wherein R has the above meaning and $R_2$ is selected from linear or branched alkyl radicals having a number of carbon atoms of between 6 and 25, and mixtures thereof;

c) (meth)acrylates having the general formula (III), $CH_2$=C(R)—CO—X—$R_3$, in a quantity of between 1 and 6% by weight, wherein R has the above meaning, —X— is oxygen or —NH— or —$NR_4$—, wherein $R_4$ is an alkyl radical having from 1 to 5 carbon atoms, and $R_3$ is selected from linear, branched or cyclic alkyl radicals having a total number of carbon atoms of between 4 and 20 and a number of tertiary nitrogen atoms of from 1 to 2;

d) (meth)acrylates having the general formula (IV), $CH_2$=C(R)—$COOR_5$, in a quantity of between 1 and 9% by weight, wherein R has the above meaning and $R_5$ is selected from linear, branched or cyclic alkyl radicals having a number of carbon atoms of between 2 and 20 and a number of oxygen atoms of the hydroxyl and/or alkoxyl type of between 1 and 2, and mixtures thereof, the term alkoxyl meaning a —$OR_6$ group, wherein $R_6$ is a linear or branched $C_1$–$C_4$ alkyl radical, the total percentage of the components from (a) to (d) being equal to 100, the above composition of polymerizable monomers being further characterized in that the ratio between the equivalents of oxygen of the (meth)acrylates of (d) and the equivalents of nitrogen of the (meth)acrylates of (c) is between 1/1 and 2/1.

2. The additive according to claim 1, characterized in that the polymerizable composition comprises:

1) (meth)acrylates (a) in a quantity of between 0 and 10% by weight;

2) (meth)acrylates (b) in a quantity of between 88 and 97% by weight;

3) (meth)acrylates (c) in a quantity of between 1.5 and 5% by weight;

4) (meth)acrylates (d) in a quantity of between 1.5 and 7% by weight;

the total percentage of the components from (a) to (d) being equal to 100.

3. The additive according to claim 1, characterized in that the ratio between the equivalents of oxygen of the (meth) acrylates of (d) and the equivalents of nitrogen of the (meth)acrylates of (c) is between 1.1/1 and 1.6/2.

4. The additive according to claim 1, characterized in that in all the monomers from (a) to (d), —R— is equal to —$CH_3$.

5. The additive according to claim 1, characterized in that in the (meth)acrylates (b), —$R_2$— is a mixture of $C_{10}$–$C_{20}$ alkyl radicals.

6. The additive according to claim 1, characterized in that in the (meth)acrylates (c), —X— is —O— and —$R_3$— is —$CH_2$—$CH_2$—N—$(CH_3)_2$.

7. The additive according to claim 1, characterized in that in the (meth)acrylates (d), —$R_5$— is selected from 2-hydroxypropyl and 3-hydroxypropyl and related mixtures.

8. A process for the preparation of a copoly(meth)acrylate which comprises:

a) (meth)acrylates having the general formula (I), $CH_2$=C(R)—$COOR_1$, in a quantity of between 0 and 19% by weight, and wherein R is selected from —H and —$CH_3$, $R_1$ is selected from linear or branched, $C_1$–$C_4$ alkyl radicals;

b) (meth)acrylates having the general formula (II), $CH_2$=C(R)—$COOR_2$, in a quantity of between 85 and 98% by weight, wherein R has the above meaning and $R_2$ is selected from linear or branched alkyl radicals having a number of carbon atoms of between 6 and 25, and mixtures thereof;

c) (meth)acrylates having the general formula (III), $CH_2$=C(R)—CO—X—$R_3$, in a quantity of between 1 and 6% by weight, wherein R has the above meaning, —X— is oxygen or —NH— or —$NR_4$—, wherein $R_4$ is an alkyl radical having from 1 to 5 carbon atoms, and $R_3$ is selected from linear, branched or cyclic alkyl radicals having a total number of carbon atoms of between 4 and 20 and a number of tertiary nitrogen atoms of from 1 to 20;

d) (meth)acrylates having the general formula (IV), $CH_2$=C(R)—$COOR_5$, in a quantity of between 1 and 9% by weight, wherein R has the above meaning and $R_5$ is selected from linear, branched or cyclic alkyl radicals having a number of carbon atoms of between 2 and 20 and a number of oxygen atoms of the hydroxyl and/or alkoxyl type of between 1 and 2, and mixtures thereof, the term alkoxyl meaning a —$OR_6$ group, wherein $R_6$ is a linear or branched $C_1$–$C_4$ alkyl radical;

wherein the total percentage of the components from (a) to (d) are equal to 100, and the composition of polymerizable monomers has a ratio of between the equivalents of oxygen of the (meth)acrylates of (d) and the equivalents of nitrogen of the (meth)acrylates of (c) is between 1/1 and 2/1;

said process comprising:

e) charging a polymerization reactor with a quantity of between 25% and 55%, of polymerizable monomers and with almost the total quantity of a radical polymerisation catalyst and a hydrocarbon solvent, f) feeding the reactor with the remaining quantity of polymerizable monomeric composition in a time of between 10 and 120 minutes, g) continuing the polymerization until a conversion degree of the monomers of more than 97%, and wherein said process is carried out at temperatures of between 75° C. and 130° C.

9. The process according to claim 8, characterized in that the polymerization reactor is initially charged with a quantity of monomers of between 30 and 50% of the total polymerizable composition.

10. The process according to claim 8, characterized in that the remaining quantity of the polymerizable composition is fed in step (b) in a time of between 15 and 80 minutes.

11. The process according to claim 8, characterized in that the polymerization is continued until a conversion degree of the monomers of more than 98%.

12. The process according to claim 8, characterized in that the polymerization process is carried out at a temperature of between 80° C. and 100° C.

13. A concentrate solution comprising an inert solvent and the copoly(meth)acrylate according to claim 1 present in a quantity of between 50 and 60% by weight.

14. The solution in an inert solvent according to claim 13, wherein the poly(meth)acrylate is present in a quantity of between 45 and 55%.

15. The solution in an inert solvent according to claim 13, wherein the solvent is mineral oil.

16. The process according to claim 8, wherein the radical polymerization catalyst is a peroxide.

17. The process according to claim 8, wherein the hydrocarbon solvent is a mineral oil.

18. The additive according to claim 1, wherein the (meth) acrylates in step (a) is present in a quantity of between 0 and 10% by weight.

* * * * *